US010916369B2

(12) United States Patent
Sattel et al.

(10) Patent No.: US 10,916,369 B2
(45) Date of Patent: Feb. 9, 2021

(54) INDUCTOR FOR HIGH FREQUENCY AND HIGH POWER APPLICATIONS

(71) Applicant: KONINKLIJKE PHILIPS N.V., Eindhoven (NL)

(72) Inventors: Timo Frederik Sattel, Norderstedt (DE); Oliver Woywode, Hamburg (DE); Jens Radvan, Hamburg (DE); Christian Willy Vollertsen, Oststeinbek (DE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/337,164

(22) PCT Filed: Nov. 8, 2017

(86) PCT No.: PCT/EP2017/078598
§ 371 (c)(1),
(2) Date: Mar. 27, 2019

(87) PCT Pub. No.: WO2018/087145
PCT Pub. Date: May 17, 2018

(65) Prior Publication Data

US 2020/0035403 A1 Jan. 30, 2020

(30) Foreign Application Priority Data

Nov. 8, 2016 (EP) ..... 16197706

(51) Int. Cl.
*H05G 1/10* (2006.01)
*H01F 27/28* (2006.01)
*H01F 27/24* (2006.01)

(52) U.S. Cl.
CPC ..... *H01F 27/2895* (2013.01); *H01F 27/24* (2013.01); *H01F 27/2823* (2013.01); *H05G 1/10* (2013.01)

(58) Field of Classification Search
None
See application file for complete search history.

(56) References Cited

U.S. PATENT DOCUMENTS 1,653,951 A * 12/1927 Featherstone ..... H01F 17/02 330/112
1,656,933 A 1/1928 Ahlstrand
(Continued)

FOREIGN PATENT DOCUMENTS

CN 2413352 Y 1/2001
CN 105448453 A 3/2016
(Continued)

OTHER PUBLICATIONS

Sullivan C.R. et al., "Prospets fort Advances in Power Magnetics", CIPS 2016—9th International Conference on Integrated Power Electronics Systems.

*Primary Examiner* — Thomas R Artman
(74) *Attorney, Agent, or Firm* — Larry Liberchuk

(57) ABSTRACT

The present invention relates to an inductor (10) for high frequency and high power applications. The inductor (10) comprises at least one wire conductor (20), and a coil zone (30). Windings of the at least one wire conductor comprises the at least one wire conductor being wound around the coil zone to form a substantially torus shape centred around an axis extending in an axial direction of the torus shape. At an outer extent of the coil zone, outer windings of the at least one wire conductor are substantially at a first radial distance from the axis. At an inner extent of the coil zone, inner windings of the at least one wire conductor are substantially at a second radial distance from the axis and substantially at
(Continued)

a third radial distance from the axis respectively. When an inner winding of the at least one conductor is at the second radial distance the next inner winding of the at least one conductor is at the third radial distance.

13 Claims, 6 Drawing Sheets

(56) References Cited

U.S. PATENT DOCUMENTS

| | | | | |
|---|---|---|---|---|
| 4,725,938 | A | 2/1988 | Onodera | |
| 5,543,773 | A | 8/1996 | Evans | |
| 7,120,991 | B2 * | 10/2006 | Yoshimori | H01F 17/062 29/606 |
| 7,400,708 | B2 | 7/2008 | Takahashi | |
| 8,553,841 | B2 * | 10/2013 | Cooley | H02M 7/003 378/107 |
| 2004/0172806 | A1 * | 9/2004 | Yoshimori | H01F 41/098 29/605 |
| 2005/0212644 | A1 | 9/2005 | Yoshimori | |
| 2012/0020463 | A1 * | 1/2012 | Cooley | H02M 7/106 378/101 |
| 2015/0228393 | A1 | 8/2015 | Waffler | |
| 2016/0226470 | A1 | 8/2016 | Hartmann | |
| 2020/0035403 | A1 * | 1/2020 | Sattel | H05G 1/10 |

FOREIGN PATENT DOCUMENTS

| | | | | |
|---|---|---|---|---|
| EP | 0668597 | A1 | 8/1995 | |
| EP | 1414051 | A1 | 4/2004 | |
| GB | 190809 | | 12/1922 | |
| GB | 190809 | A * | 12/1922 | H01F 17/02 |
| JP | H0322094 | A | 1/1991 | |
| JP | 2000147023 | A | 5/2000 | |
| JP | 2001102230 | A | 4/2001 | |
| JP | 2003086438 | A | 3/2003 | |
| KR | 20130032102 | A | 4/2013 | |
| SE | 102011005446 | A1 | 9/2012 | |

* cited by examiner

INDUCTOR FOR HIGH FREQUENCY AND HIGH POWER APPLICATIONS

FIELD OF THE INVENTION

The present invention relates to an inductor for high frequency and high power applications, to a high power generator, to an apparatus for generating X-rays, and to a method for generating X-rays, as well as to a computer program element and a computer readable medium.

BACKGROUND OF THE INVENTION

Modern generators have to operate at high powers and frequencies. For example, X-ray generators have to deliver peak powers between 30 kW and 120 kW, and power inverters work at high frequencies of the order of 20 to 100 kHz. To minimize losses it is further known to use resonance inverters. These circuits demand at least a resonance inductor and a capacitor. The total system inductance is defined by the stray inductance that is inherent to any high voltage transformer and an additional resonance inductor. There are designs known where the transformer delivers the complete inductance. (Such a transformer is described in DE102014202531A1).

These solutions have the drawback that they are linked to relatively high stray fields, which can produce eddy currents in adjacent parts like printed circuit boards and metal enclosures.

EP1414051A1 describes a method for manufacturing a coil device comprising a step for manufacturing an air core coil, and a step for fixing the air core coil to the periphery of a core. In the step for manufacturing an air core coil, an air core coil, where each of a plurality of unit winding parts arranged in the direction of winding axis has one or a plurality of number of turns and unit winding parts adjacent in the direction of winding axis have different inner circumferential lengths, is manufactured.

U.S. Pat. No. 1,656,933A relates to a method of manufacturing toroid coils of the kind in which the windings form at the inner circumference of the coil and double layer at the outer circumference of the coil a single layer.

SUMMARY OF THE INVENTION

It would be advantageous to have an improved technique for generating high power at high frequencies that would have general utility, including that for X-ray sources. The object of the present invention is solved with the subject matter of the independent claims, wherein further embodiments are incorporated in the dependent claims. It should be noted that the following described aspects of the invention apply also for the inductor for high frequency and high power applications, the high power generator, the apparatus for generating X-rays, the method for generating X-rays, and for the computer program element and the computer readable medium.

In a first aspect, there is provided an inductor for high frequency and high power applications, comprising:

at least one wire conductor; and a coil zone.

Windings of the at least one wire conductor comprises the at least one wire conductor being wound around the coil zone to form a substantially torus shape centred around an axis extending in an axial direction of the torus shape. At an outer extent of the coil zone, outer windings of the at least one wire conductor are substantially at a first radial distance from the axis. At an inner extent of the coil zone, inner windings of the at least one wire conductor are substantially at a second radial distance from the axis and substantially at a third radial distance from the axis respectively. When an inner winding of the at least one conductor is at the second radial distance the next inner winding of the at least one conductor is at the third radial distance.

In other words, a double winding scheme is used, where instead of using a single turn around a core two turns are used. To put this another way, on the inner side of the toroid the turns are on top of each other, whilst on the outer side of the toroid the turns are adjacent to one another. Thus, a toroidal shaped has double windings (or indeed triple windings) around it again in a toroidal shape, where on the outer extent of the coil zone the windings are adjacent to one another whilst on the inner extent of the coil zone the windings sit on top of one another, with two turnings sitting on top of each other for the double winding scheme and three windings sitting on top of each other for the triple winding scheme.

To put this another way, an inductor for high frequency, high power and low noise applications is provided, where a high quality factor of the coil is provided. Thus, high stored energy capability, coupled with low losses is enabled.

In this manner, stray fields can be reduced.

In this way, applicability is provided where tight electromagnetic compatibility is required, and/or for high performance applications.

Furthermore, the inductor does not suffer from high losses at high frequencies and power. The inductor coil does not experience high ac losses due to the following: 1) Litz wire can be used, which minimizes losses due to skin and proximity effect, 2) an optimized cross section of the core can be calculated, 3) stray fields are reduced by the winding scheme, thus stray field induced losses by eddy currents in metal enclosures are reduced.

Thus eddy current losses in metal enclosures and interference in adjacent electronics, such as in pcbs, can be mitigated.

To put this another way, any circuit using an inductor can utilise the inductor having the double (and indeed triple) winding scheme, and in this stray fields can be reduced and electromagnetic compatibility and high performance improved.

In an example, at the inner extent of the coil zone, windings of the at least one wire conductor are formed as pairs of windings. A radial line from the axis that extends through a first winding of a pair of windings also substantially extends through a second winding of the pair of windings.

In other words, the inner windings can be placed exactly on top of each other. In an example, the first radial distance is substantially twice the average of the second and third radial distances.

In this manner, the wires on the inner side of the coil zone can be touching each other with no gaps between the wires, and similarly the wires on the outer side of the coil zone can be touching each other with no gaps between the wires.

To put this another way, the winding scheme approximates or forms a copper shield (or copper layer) around the core (coil zone). In this way, the magnetic flux is confined to the core. The shielding is more effective in preventing flux leakage when there are less gaps in the shield, i.e., there are fewer and smaller gaps between the windings. If you do not place the inner windings exactly on top of each other you will need a larger inner radius than otherwise would be required, and the outer radius would not be N times the inner radius. There would then be more gaps than necessary on the outer radius of the toroid and the shield formed by the winding possess would not be as effective.

In this manner, stray fields can be reduced.

In the first aspect, the coil zone comprises an air gap, and wherein windings of the at least one wire conductor comprises at least one winding of the at least one wire conductor being taken back through the air gap.

In other words, a compensation winding is provided that is taken back through the centre of the coil windings.

In this manner, stray fields produced due to the windings being a spiral rather than a series of circles can be reduced.

To put this another way, one winding is provided in the air gap along the magnetic axis in a direction counter wise to the main winding, and in this manner a portion of field resulting from the winding direction on the core is compensated.

In an example, a former is positioned within the air gap. The former has at least one support. The at least one support is configured such that the at least one winding of the at least one wire conductor that is taken back through the air gap is supported by the at least one support.

In an example, the at least one conductor comprises a first wire conductor and a second wire conductor. The windings are formed from the first wire conductor and the second wire conductor.

In other words, instead of using a single wire with two turns, two wires are used to accomplish the double winding (or two wires to achieve triple winding with one wire being double wound, or three wires achieving a triple winding).

In this manner, the self resonance of the coil is increased.

The direction of the two coil windings is such that they assist each other in producing the magnetic flux. In general terms: the direction of all coil windings (or sub-coil windings) and the electrical connection of all sub-coils is such that they assist each other in producing the desired magnetic flux.

To put this another way, two complete coils are provided, which both form the torus around the coil zone, which can comprise or be an air gap.

In an example, windings of the at least one wire conductor are formed as pairs of windings. A first pair of windings comprises the first wire conductor at the second radial distance and the second wire conductor at the third radial distance. A pair of windings adjacent to the first pair of windings comprises the first wire conductor at the third radial distance and the second wire conductor at the second radial distance.

In other words, when using the two wires instead of one wire, the two wires alternate in that if one wire was on top of the other on the inner side of the toroid on one turn, it is on the bottom on the inner side of the toroid during the next turn. It is not necessary that this alternating scheme takes place strictly after each turn. Rather, this alternating of which wire is on top of the other on the inner side of the toroid can be applied after each second or third turn or even after more than the third turn. However, in doing this the alternating scheme is provided in order that each wire is as often at the same place (bottom or top position at the inner radius—inner side of the toroid) as the other wire.

This can be expanded to more than 2 wires with the appropriate alternating winding scheme. As the number of wires can be increased to make a turn winding (using two wires in parallel to make one turn can be considered to be equivalent in terms of energy to using one wire making two turns) so can the number of sub-coils or coil-segments to form a complete coil. Therefore, two halve coils can be connected in series or in parallel and share a common core (e.g. air core). However, more than two coils can be used (e.g. 6 or 12 sub-coils). These sub-coils again can be connected in series or in parallel to end up with the desired inductance value of the complete coil. This offers more design flexibility.

Thus, one toroidal coil can be split into as many sub-coils as wanted. Each sub-coil can be made using double or triple winding. These multiple windings can be made using parallel wires, rather than as one wire as a single winding.

To put this another way, using two wires in parallel to make one turn is equivalent in terms of energy to using one wire making two turns. This increases the coil's self-resonance because less turns translate into higher self-resonance which is beneficial in certain applications. This effect becomes obviously more pronounced if more wires are being used: Three wires in parallel making one turn is equal to one wire making three turns. When using more than one wire, the alternating scheme is maintained, and in this way the current is distributed equally amongst the wires.

In an example, the coil zone comprises an air gap, and a winding of the first wire conductor is taken back through the air gap, and a winding of the second wire conductor is taken back through the air gap.

In an example, connection terminals for the at least one conductor are positioned adjacent to one another.

In this manner, simplicity of electrical connection is facility.

In an example, the at least one conductor comprises Litz wire.

The use of Litz wire facilitates the embodiment of complex wiring geometries, and also helps facilitates the double and triple windings schemes discussed. The use of Litz wire, in the form of a wire formed from a bundle of individual wires, reduces the negative impact of the skin effect due to current flow in its own wire. The use of Litz wire, in the form of a wire formed from a bundle of individual wires, reduces the negative impact of the proximity effect leading to surface current flow due to current flow in an adjacent wire—this could otherwise be a problem on the inner extent of the coil zone (e.g. air gap), which can lead to a.c. losses.

In a second aspect, there is provided a high power generator, comprising:

an inductor for high frequency and high power applications according to the first aspect.

In a third aspect, there is provided an apparatus for generating X-rays, comprising:

an X-ray source;

a power supply, comprising a high power generator according to the second aspect.

The power supply is configured to produce a voltage. The X-ray source comprises a cathode and an anode. The cathode is positioned relative to the anode, and the cathode and anode are operable such that electrons emitted from the cathode interact with the anode with energies corresponding to the voltage. The electrons interact with the anode to generate X-rays.

In a fourth aspect, there is provided a method for generating X-rays, comprising:

producing with a power supply a voltage, wherein production of the voltage comprises utilising a high power generator according to the second aspect;

positioning a cathode of an X-ray source relative to an anode of the X-ray source;

emitting electrons from the cathode;

interacting electrons emitted from the cathode with the anode with energies corresponding to the voltage;

generating X-rays from the anode, wherein the electrons interact with the anode to generate the X-rays.

According to another aspect, there is provided a computer program element controlling apparatus as previously described which, in the computer program element is executed by processing unit, is adapted to perform the method steps as previously described.

According to another aspect, there is provided a computer readable medium having stored computer element as previously described.

Advantageously, the benefits provided by any of the above aspects equally apply to all of the other aspects and vice versa.

The above aspects and examples will become apparent from and be elucidated with reference to the embodiments described hereinafter.

BRIEF DESCRIPTION OF THE DRAWINGS

Exemplary embodiments will be described in the following with reference to the following drawings.

DETAILED DESCRIPTION OF EMBODIMENTS

Figure 1:
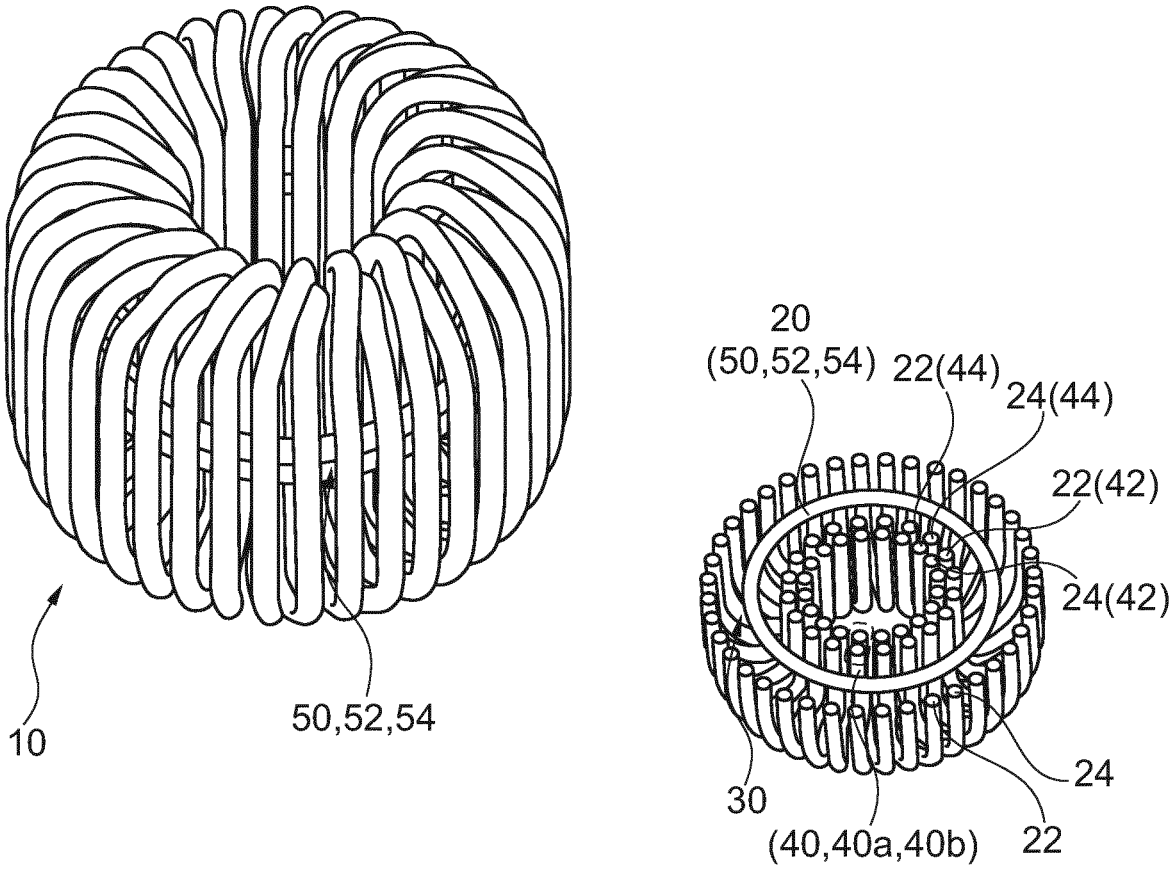
FIG. 1 shows a schematic example of an inductor in the left hand drawing where 2 wires are in parallel, twisted for 180° per winding, and a cut through section of the inductor in the right hand drawings.
Figure 2:
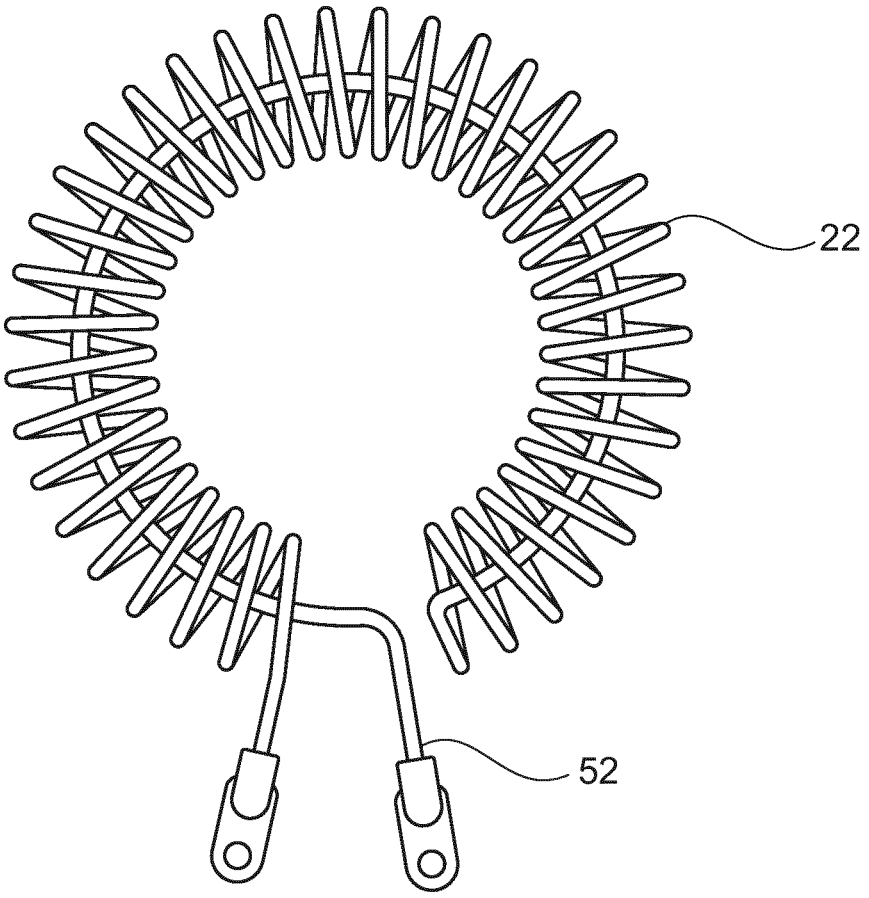
FIG. 2 shows a schematic example of a first winding of an inductor.

FIG. 1 shows a schematic example of an inductor 10 in the left hand drawing and a cut through section of the inductor shown in the right hand drawing. A compensation winding 50, that can be formed from windings 52 and 54 of a first wire conductor 22 and a second wire conductor 24 of at least one wire conductor 20, is shown within an air gap. However, the double, and indeed triple, winding scheme described here can be used around cores other than air cores, such as magnetic cores, in which case a compensation winding 50 may not be used. Therefore, the windings can be considered to be around a coil zone 30, rather than necessarily around an air gap. Also, rather than using at least one wire conductor 20 in the form of two wires 22 and 24 (or indeed three wires), a single wire can be used to form the double winding described below. Also, it is to be noted that the inductor shown in FIG. 1 is represented schematically, such that the compensation winding 50 is not shown as being formed from the windings around the core—this is presented in FIG. 1 for simplicity of representation. FIG. 2 shows how one wire 22 of the at least one wire conductor can be wound around an air core, with a winding 52 being taken back through the air core. In FIG. 2, again for simplicity the second wire conductor 24 is not shown, however as shown in FIG. 1 it would also be wound around the air core such that two windings would be on top of each other on the inner side of the core, but adjacent to one another on the outer side of the core. Also, rather than having two wires, the single wire 22 could be wound in a double winding configuration.

Figure 3:
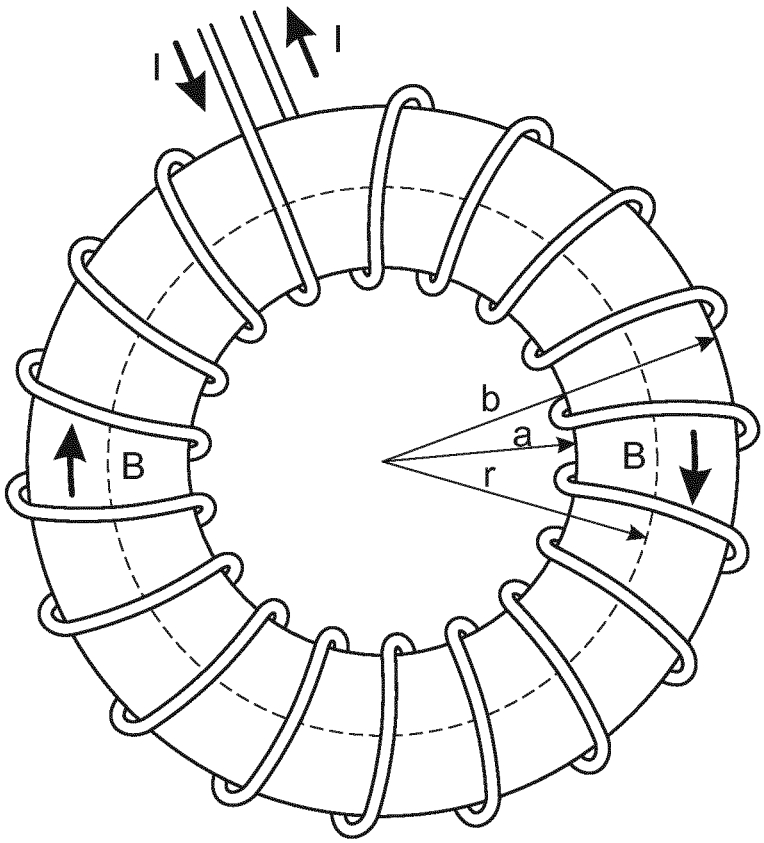
FIG. 3 shows a schematic example of a winding of an inductor.

Referring to FIG. 1 in more detail, an inductor 10 for high frequency and high power applications is shown. The inductor 10 comprises at least one wire conductor 20, and a coil zone 30. Windings of the at least one wire conductor 20 comprises the at least one wire conductor 20 being wound around the coil zone 30 to form a substantially torus shape centred around an axis extending in an axial direction of the torus shape. Thus the axis extends down through the centre of the windings shown in FIG. 1, and referring to FIG. 3 the axis extends out of the page at the position from which radii r, a, and b extend. With continued reference to FIG. 1 at an outer extent of the coil zone 30, outer windings of the at least one wire conductor 20 are substantially at a first radial distance from the axis. At an inner extent of the coil zone 30, inner windings of the at least one wire conductor 20 are substantially at a second radial distance from the axis and substantially at a third radial distance from the axis respectively. When an inner winding of the at least one conductor 20 is at the second radial distance the next inner winding of the at least one conductor is at the third radial distance. Thus referring to FIG. 3, which shows a simplified inductor that for ease of visualization has not shown the above described double winding, the outer windings are at a first radius b, and inner windings rather than being the single windings shown in FIG. 3, are actually in the double windings shown in FIG. 1. Thus, the inner radius a, in the inductor 10 is actually two radii of windings.

In an example, the windings of the at least one wire at the first radial distance are exactly adjacent to one another, or in other words touching. In other words, the windings at the outer side of the core (or coil zone) are butted up against each other.

In an example, the windings of the at least one wire at the third radial distance are exactly adjacent to one another, or in other words touching. In other words, the windings at the inner side of the coil zone are butted up against each other.

In an example, at an inner extent of the coil zone, windings of the at least one wire conductor are substantially at the second radial distance from the axis and substantially at the third radial distance from the axis respectively, and substantially at a fourth radial distance from the axis. In other words, a triple winding scheme is used, where instead of using a single turn around a coil zone three turns are used. To put this another way, on the inner side of the toroid the three turns are on top of each other, whilst on the outer side of the toroid the turns are adjacent to one another.

In an example, the coil zone comprises an air gap.

By having an air core, rather than a magnetic core, at high power levels required for example for an X-ray generator, high losses at high frequencies are mitigated and the demands associated with thermal management are reduced. Inductors of any inductance value are then realisable, which are compatible with switching technologies based on wide band gap semiconductors such as SiC and GaN, which can operate at switching frequencies above 100 kHz and up to 1 MHz and at currents of several hundred Amps.

According to an example, at the inner extent of the coil zone 30, windings of the at least one wire conductor 20 are formed as pairs of windings 40. A radial line from the axis that extends through a first winding 40*a* of a pair of windings also substantially extends through a second winding 40*a* of the pair of windings.

In an example, at the inner extent of the coil zone, windings of the at least one wire conductor are formed as a triplet of windings. A radial line from the axis that extends through a first one of the triplet of windings also substantially extends through a second one of the triplet of windings, and also extends through a third one of the triplet of windings.

In an example, the outer radius is approximately N times the inner radius, where N is the number layers on windings on the inner radius. Thus inductors with N=2 and N=3 and higher numbers are possible.

According to an example, the first radial distance is substantially twice the average of the second and third radial distances.

In an example, the first radial distance is substantially three times the average of the second and third and fourth radial distances. Thus, again the wires on the inner side of the coil zone can be touching one another as can the wires on the outer side of the coil zone. According to an example, the coil zone 30 comprises an air gap, and windings of the at least one wire conductor 20 comprises at least one winding 50 of the at least one wire conductor being taken back through the air gap.

In an example, the "return" winding is placed coaxially with the coil geometry within the coil's centre plane.

In an example, the at least one winding of the at least one wire conductor being taken back through the air gap is at a radius from the axis such that resulting stray fields are minimized. The specific radius can be determined through simulation and/or manual adaptation.

Figure 4:
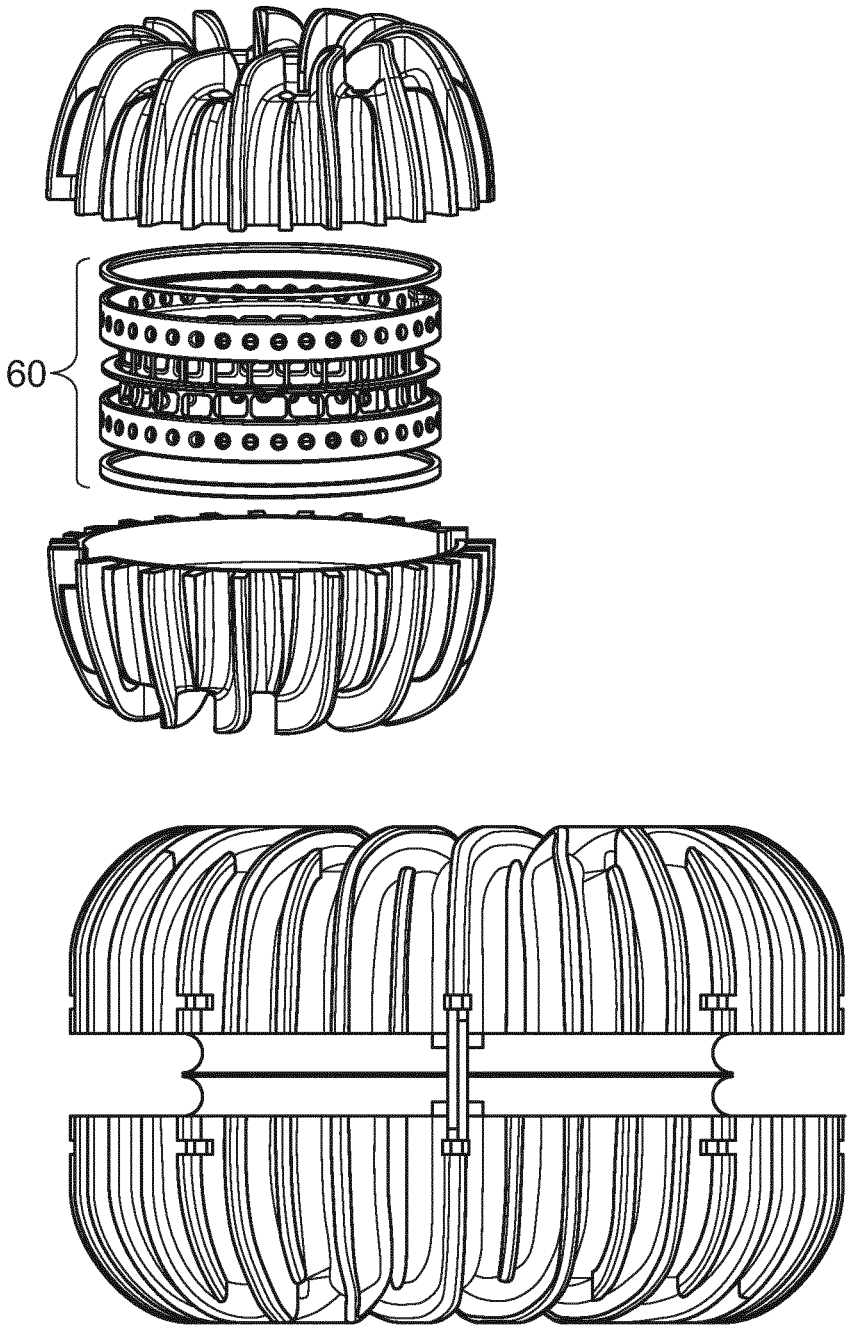
FIG. 4 shows a schematic example of a coil former in dissembled form in the top drawing and in assembled form in the bottom drawing.

According to an example, a former is positioned within the air gap 30. The former has at least one support. The at least one support is configured such that the at least one winding 50 of the at least one wire conductor 20 that is taken back through the air gap is supported by the at least one support. An example of a former is shown in FIG. 4.

In an example, a ring structure 60 is positioned within the air gap 30. The ring structure has at least one groove. The at least one groove is configured such that the at least one winding 50 of the at least one wire conductor 20 that is taken back through the air gap sits in the at least one groove. An example of a ring structure is shown in FIG. 4.

In this manner, the compensation winding(s) can be accurately positioned and maintained in position.

In an example, the ring structure is made from thermoplastic. According to an example, the at least one conductor 20 comprises a first wire conductor 22 and a second wire conductor 24. The windings are formed from the first wire conductor and the second wire conductor.

In an example, the at least one conductor comprises a first wire conductor and a second wire conductor and a third wire conductor. The windings are formed from the first wire conductor and the second wire conductor and the third wire conductor. In other words, instead of using a single wire with three turns, three wires are used to accomplish the double winding.

According to an example, windings of the at least one wire conductor 20 are formed as pairs of windings 40. A first pair of windings 42 comprises the first wire conductor 22 at the second radial distance and the second wire conductor 24 at the third radial distance. A pair of windings 44 adjacent to the first pair of windings comprises the first wire conductor 22 at the third radial distance and the second wire conductor 24 at the second radial distance.

According to an example, the coil zone comprises an air gap. A winding 52 of the first wire conductor 22 is taken back through the air gap 30, and a winding 54 of the second wire conductor 24 is taken back through the air gap.

In an example, a winding of a third wire conductor is taken back through the air core.

According to an example, connection terminals for the at least one conductor are positioned adjacent to one another.

In an example, the at least one conductor can be any normal type of wire, such as a copper wire.

In an example, the at least one conductor can be formed from a bundle of individual wires.

According to an example, the at least one conductor 20 comprises Litz wire.

In an example, the inductor is configured to operate at frequencies up to 100 kHz. In an example, the inductor is configured to operate at frequencies up to 1 MHz. In an example, the inductor is configured to operate at currents up to 100 Amps. In an example, the inductor is configured to operate at currents up to 1000 Amps at 150 kHz using only air cooling with natural convection.

Figure 5:
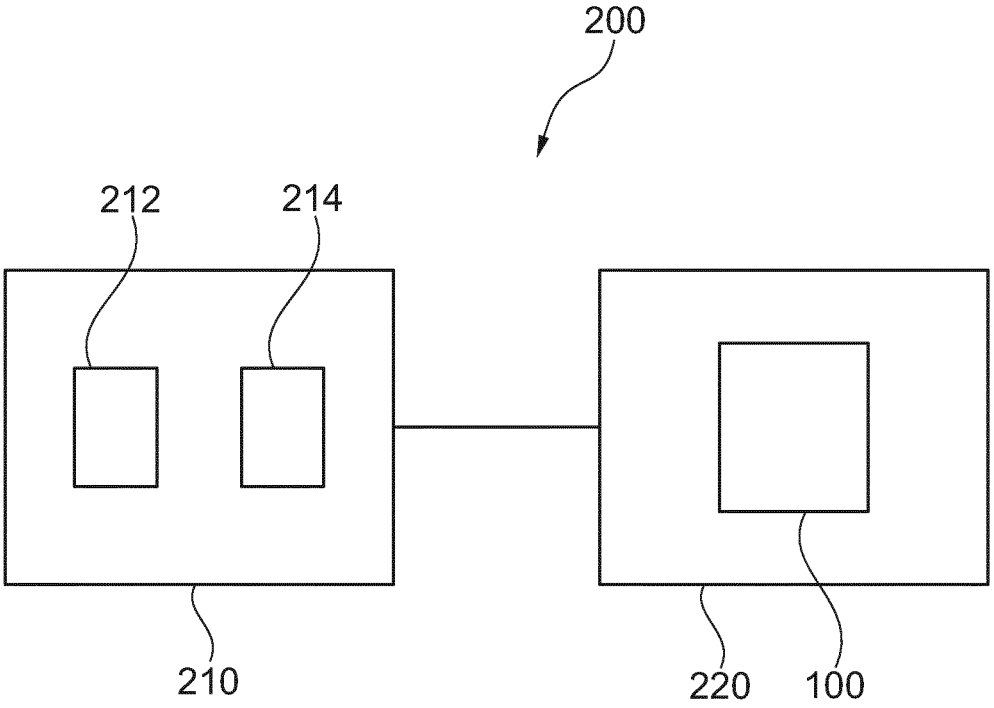
FIG. 5 shows a schematic example of an apparatus for generating X-rays.

FIG. 5 shows an apparatus 200 for generating X-rays. The apparatus 200 comprises a high power generator 100. The high power generator comprises an inductor 10 for high frequency and high power applications according as described with respect to FIGS. 1-3. The high power generator thus has applicability in high power systems such as X-ray generators, but also for example in automotive applications. When an air core is utilized, the core will not saturate even in high power applications. Because saturation issues do not exist the coil offers excellent linearity. With an air core there are no core losses. Also, since the air core has no losses and no saturation there is no temperature dependent drift of core properties. Thus, an inductor (e.g. having an air core), which has high frequency and high power and low noise applicability, can be used to effectively generate high power.

With continued reference to FIG. 5, the apparatus 200 for generating X-rays comprises an X-ray source 210, and a power supply 220, comprising a high power generator 100 as described above. The power supply 220 is configured to produce a voltage. The X-ray source 210 comprises a cathode 212 and an anode 214. The cathode 212 is positioned relative to the anode 214, and the cathode 212 and anode 214 are operable such that electrons emitted from the cathode 212 interact with the anode 214 with energies corresponding to the voltage. The electrons interact with the anode 214 to generate X-rays.

Figure 6:
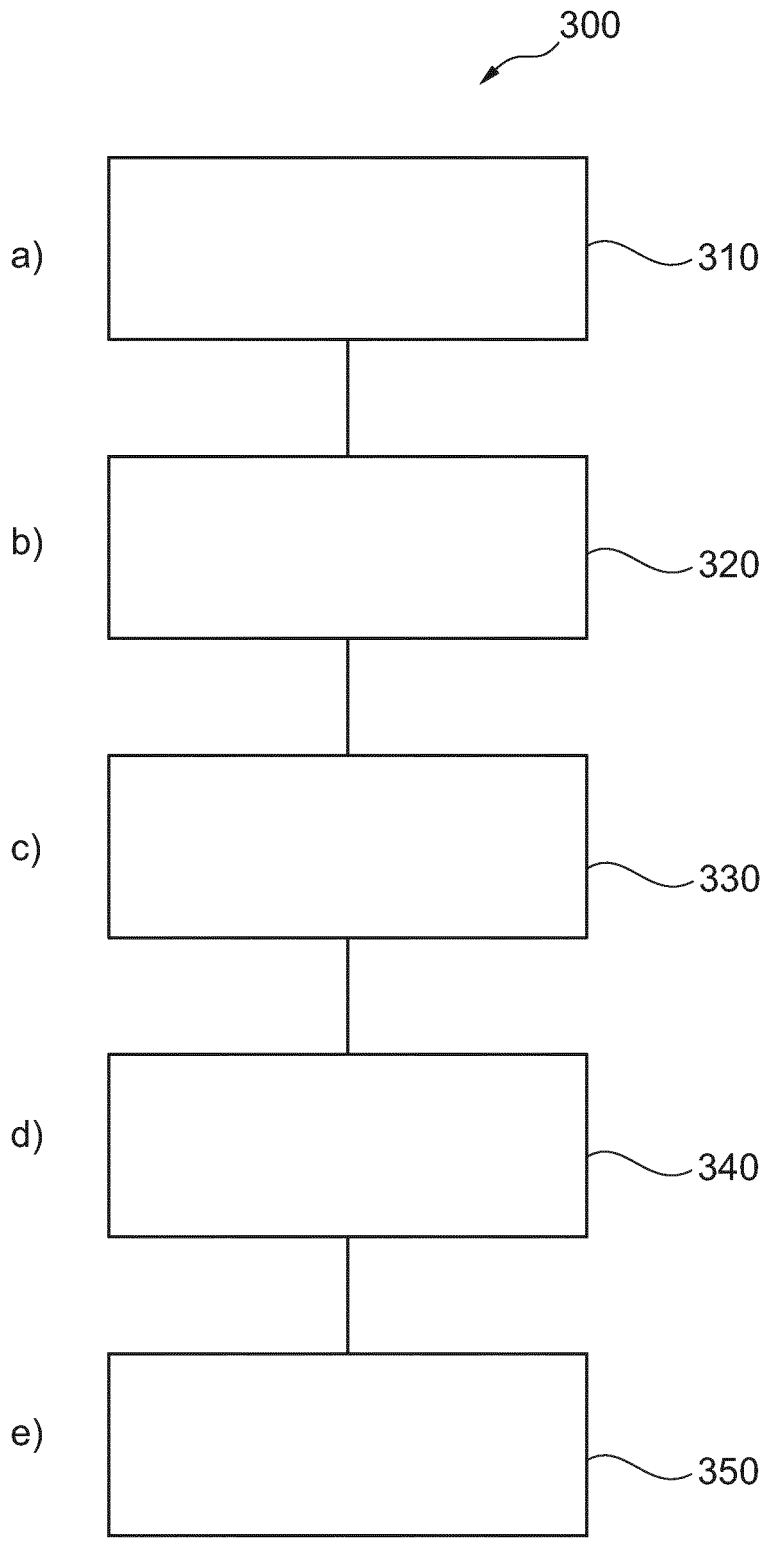
FIG. 6 shows an example of a method for generating X-rays.

FIG. 6 shows a method 300 for generating X-rays in its basic steps. The method 300 comprises:

- in a producing step 310, also referred to as step a), producing with a power supply 220 a voltage, wherein production of the voltage comprises utilising a high power generator 100;
- in a positioning step 320, also referred to as step b), positioning a cathode 212 of an X-ray source 210 relative to an anode 214 of the X-ray source 210;
- in an emitting step 330, also referred to as step c), emitting electrons from the cathode 212;
- in an interacting step 340, also referred to as step d), interacting electrons emitted from the cathode 212 with the anode 214 with energies corresponding to the voltage;
- in a generating step 350, also referred to as step e), generating X-rays from the anode 214, wherein the electrons interact with the anode 214 to generate the X-rays.

In another exemplary embodiment, a computer program or computer program element is provided that is characterized by being configured to execute the method steps of the method according to one of the preceding embodiments, an appropriate system.

The computer program element might therefore be stored on a computer unit, which might also be part of an embodiment. This computing unit may be configured to perform or induce performing of the steps of the method described above. Moreover, it may be configured to operate the components of the above described apparatus. The computing unit can be configured to operate automatically and/or to execute the orders of a user. A computer program may be loaded into a working memory of a data processor. The data processor may thus be equipped to carry out the method according to one of the preceding embodiments.

This exemplary embodiment of the invention covers both, a computer program that right from the beginning uses the invention and computer program that by means of an update turns an existing program into a program that uses invention.

Further on, the computer program element might be able to provide all necessary steps to fulfill the procedure of an exemplary embodiment of the method as described above.

According to a further exemplary embodiment of the present invention, a computer readable medium, such as a CD-ROM, is presented wherein the computer readable medium has a computer program element stored on it which computer program element is described by the preceding section.

A computer program may be stored and/or distributed on a suitable medium, such as an optical storage medium or a solid state medium supplied together with or as part of other hardware, but may also be distributed in other forms, such as via the internet or other wired or wireless telecommunication systems.

However, the computer program may also be presented over a network like the World Wide Web and can be downloaded into the working memory of a data processor from such a network. According to a further exemplary embodiment of the present invention, a medium for making a computer program element available for downloading is provided, which computer program element is arranged to perform a method according to one of the previously described embodiments of the invention.

It has to be noted that embodiments of the invention are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing a claimed invention, from a study of the drawings, the disclosure, and the dependent claims.

In the claims, the word "comprising" does not exclude other elements or steps, and the indefinite article "a" or "an" does not exclude a plurality. A single processor or other unit may fulfill the functions of several items re-cited in the claims. The mere fact that certain measures are re-cited in mutually different dependent claims does not indicate that a combination of these measures cannot be used to advantage. Any reference signs in the claims should not be construed as limiting the scope

The invention claimed is:

1. An inductor for high frequency and high power applications in X-ray generation, comprising:

at least one wire conductor forming a plurality of windings that include a plurality of inner windings and a plurality of outer windings;

a coil zone;

wherein the windings are wound around the coil zone to form substantially a torus centered around an axis extending in an axial direction of the torus;

wherein at an outer side of the coil zone the outer windings are substantially at a first radial distance from the axis;

wherein at an inner side of the coil zone the inner windings are substantially at a second radial distance from the axis and substantially at a third radial distance from the axis, such that when one inner winding of the plurality of the inner windings is at the second radial distance, an adjacent inner winding of the plurality of the inner windings is at the third radial distance and is in contact with the one inner winding of the plurality of the inner windings that is at the second radial distance;

wherein the coil zone comprises an air gap, and wherein at least one winding is taken through the air gap.

2. The inductor according to claim 1, wherein at the inner side of the coil zone the windings are formed as pairs of windings, wherein a radial line from the axis that extends through a first winding of a pair of windings substantially extends through a second winding of the pair of windings.

3. The inductor according to claim 1, wherein the first radial distance is substantially twice an average of the second and third radial distances.

4. The inductor according to claim 1, wherein a structure, positioned within the air gap, has at least one support that is configured such that the at least one winding that is taken through the air gap is supported by the at least one support.

5. The inductor according to claim 1, wherein the at least one conductor comprises a first wire and a second wire, and wherein the windings are formed from the first wire and the second wire.

6. The inductor according to claim 5, wherein the windings are formed as pairs of windings, and wherein a first pair of windings comprises the first wire at the second radial distance and the second wire at the third radial distance, and a second pair of windings adjacent to the first pair of windings comprises the first wire at the third radial distance and the second wire at the second radial distance.

7. The inductor according to claim 5, wherein the winding of the first wire is taken through the air gap, and the winding of the second wire is taken through the air gap.

8. The inductor according to claim 1, wherein connection terminals for the at least one conductor are positioned adjacent to one another.

9. The inductor according to claim 1, wherein the at least one conductor comprises Litz wire.

10. The inductor according to claim 1, wherein the inductor is arranged in a high power generator for use in X-ray generation.

11. An apparatus for generating X-rays, comprising:

an X-ray source; and a power supply comprising a high power generator that includes an inductor for high frequency and high power applications in X-ray generation, the inductor comprising:

at least one wire conductor forming a plurality of windings that include a plurality of inner windings and a plurality of outer windings;

a coil zone;

wherein the windings are wound around the coil zone to form substantially a torus centered around an axis extending in an axial direction of the torus;

wherein at an outer side of the coil zone the outer windings are substantially at a first radial distance from the axis;

wherein at an inner side of the coil zone the inner windings are substantially at a second radial distance from the axis and substantially at a third radial distance from the axis, such that when one inner winding of the plurality of the inner windings is at the second radial distance, an adjacent inner winding of the plurality of the inner windings is at the third radial distance and is in contact with the one inner winding of the plurality of the inner windings that is at the second radial distance;

wherein the coil zone comprises an air gap, and wherein at least one winding is taken through the air gap.

12. A method for generating X-rays, comprising:

providing an X-ray source; and providing a power supply comprising a high power generator that includes an inductor for high frequency and high power applications in X-ray generation, the inductor comprising:

at least one wire conductor forming a plurality of windings that include a plurality of inner windings and a plurality of outer windings;

a coil zone;

wherein the windings are wound around the coil zone to form substantially a torus centered around an axis extending in an axial direction of the torus;

wherein at an outer side of the coil zone the outer windings are substantially at a first radial distance from the axis;

wherein at an inner side of the coil zone the inner windings are substantially at a second radial distance from the axis and substantially at a third radial distance from the axis, such that when one inner winding of the plurality of the inner windings is at the second radial distance, an adjacent inner winding of the plurality of the inner windings is at the third radial distance and is in contact with the one inner winding of the plurality of the inner windings that is at the second radial distance;

wherein the coil zone comprises an air gap, and wherein at least one winding is taken through the air gap.

13. A non-transitory computer-readable medium having one or more executable instructions, which, when executed by a processor, cause the processor to perform a method for generating X-rays, the method comprising:

providing an X-ray source; and providing a power supply comprising a high power generator that includes an inductor for high frequency and high power applications in X-ray generation, the inductor comprising:

at least one wire conductor forming a plurality of windings that include a plurality of inner windings and a plurality of outer windings;

a coil zone;

wherein the windings are wound around the coil zone to form substantially a torus centered around an axis extending in an axial direction of the torus;

wherein at an outer side of the coil zone the outer windings are substantially at a first radial distance from the axis;

wherein at an inner side of the coil zone the inner windings are substantially at a second radial distance from the axis and substantially at a third radial distance from the axis, such that when one inner winding of the plurality of the inner windings is at the second radial distance, an adjacent inner winding of the plurality of the inner windings is at the third radial distance and is in contact with the one inner winding of the plurality of the inner windings that is at the second radial distance;

wherein the coil zone comprises an air gap, and wherein at least one winding is taken through the air gap.

* * * * *